United States Patent [19]

Honse

[11] Patent Number: 4,489,514

[45] Date of Patent: Dec. 25, 1984

[54] MOTORIZED SIGN WITH SLIDING PANELS

[76] Inventor: James J. Honse, P.O. Box 6650, Portland, Oreg. 97228

[21] Appl. No.: 409,448

[22] Filed: Aug. 19, 1982

[51] Int. Cl.[3] ..... G09F 11/00

[52] U.S. Cl. ..... 40/476

[58] Field of Search ..... 40/476, 488, 375, 380

[56] References Cited

U.S. PATENT DOCUMENTS

| | | | |
|---|---|---|---|
| 786,334 | 4/1905 | Wood | 40/488 |
| 788,126 | 4/1905 | Wood | 40/488 |
| 1,609,485 | 12/1926 | Maier | 40/488 |
| 2,117,186 | 5/1938 | MacLaren | 40/488 |
| 2,117,187 | 5/1938 | MacLaren | 40/488 |
| 2,799,105 | 7/1957 | Tilley | 40/488 |
| 2,833,066 | 5/1958 | Morrissey | 40/488 |

FOREIGN PATENT DOCUMENTS

| | | | |
|---|---|---|---|
| 888832 | 12/1971 | Canada | 40/476 |

*Primary Examiner*—Gene Mancene

*Assistant Examiner*—Wenceslao J. Contreras

*Attorney, Agent, or Firm*—James D. Givnan, Jr.

[57] ABSTRACT

A sign having several movable panels with the panels each consisting of parallel strips interleaved with the strips of the other panels. The strips of one panel present a composite display when in view. A panel drive mechanism includes an endless motor driven member from which an arm projects and successively engages panel carried abutments located at points along the path of arm travel for panel positioning. Step-like guideways for the arm include inclined segments which divert the arm to cause the arm to disengage a panel abutment to terminate panel movement. Each sign panel is formed with overlapped strips which upon incorporation into a sign forms rows of interleaved panel strips. The composite display of each panel is presented in succession upon retraction of an overlying panel's strips back into a stored row of strips and again upon drawing of the panel strips to be viewed outwardly from their row positions.

10 Claims, 11 Drawing Figures

MOTORIZED SIGN WITH SLIDING PANELS

BACKGROUND OF THE INVENTION

The present invention pertains to that type of sign having several interleaved panels which move individually to display the panels and the indicia thereon in sequence.

The prior art includes such signs which have been referred to as "slat signs" or "interleaved signs" wherein a panel provides a display by moving into view and, conversely, by retracting out of view to reveal an underlying panel.

In the past such signs relied on complicated drive mechanisms utilizing arrays of cams, levers, linkages, etc., to shift a panel into view and later retract same from view. The prior art mechanisms severely curtail the number of panels usable in a sign and accordingly restrict the sign's commercial usefulness. For example, the sign disclosed in U.S. Pat. No. 3,430,371 embodies three panels to show only three messages or visual displays to a viewer located forwardly of the sign. Additional displays or messages may be carried on the back side of the panels which, of course, are not visible to the forwardly located viewer.

U.S. Pat. Nos. 2,141,398; 2,829,456; 3,013,352; 3,080,668; 3,421,240; 4,102,608 and 4,164,086 additionally provide sliding display panels wherein manual or motorized movement of a panel repositions a panel with interleaved strips into view. Commonly, such panels are comprised of horizontal or vertical strips with the strips of a panel joined by common marginal areas to which motion is imparted by the actuating mechanism of the sign to move the strips of one panel relative to the strips of the other panels.

In addition to the drawback of only a severely limited number of displays being possible with the prior art signs, other drawbacks are high cost of manufacture and maintenance incurred by the complex actuating mechanisms. Further, the noise generated by various mechanical components render such signs usable only in "noisy" environments. The unsatisfactory relationship of overall sign size to display area is still another disadvantage to known sign construction.

SUMMARY OF THE PRESENT INVENTION

The present invention is embodied in a motorized sign capable of substantially greater numbers of displays by reason of a belt carried actuator which moves generally lengthwise along the sign in a stepped manner to engage, move and disengage each panel in sequence.

The drive mechanism for the present sign includes a belt on which a panel positioning arm is mounted with said arm traversing a stepped course first in one direction to sequentially reposition the sign's panels and thence returning along the same course to likewise position the panels in the opposite direction, all with no alteration of belt speed.

The sign defines corresponding openings of step-like configuration within which the actuating arm rides. The arm is accordingly guided into engagement with an abutment formed on each panel and, after shifting of the panel, the arm is guided out of engagement with the tab. The panels by reason of not requiring any lateral protruberances may lie in juxtaposition to permit a typical sign made in accordance with the present invention to be capable of a half dozen or so different front viewed displays.

The panels are each formed in a two ply manner from separate sheets of material which are permanently joined to provide panels with each panel having overlapped indicia bearing strips of one ply overlapping like strips of the second ply of the same panel. Accordingly, only limited panel movement is necessary for presenting a new display in distinction to the panels used in known signs wherein each panel is formed from a single sheet or ply of stamped panel material wherein the panel strips must travel a distance equal to their width dimension.

Important objectives include the provision of a motorized sliding panel sign of relatively few components and low cost manufacture yet capable of providing more displays than previous signs of the same general type; the provision of a motorized sign wherein a belt drive is equipped with an arm which traverses an irregular path along a guideway to move into and out of actuating engagement with abutments on juxtaposed panels to shift each panel after a timed interval of panel display; the provision of a motorized sign wherein the several sign panels are of two ply construction enabling the panel strips of each panel to be in overlapped relationship with one another to enable sign shifting to provide a new display with only limited panel movement; the provision of a motorized sign which dispenses with complex drive mechanisms to provide a sign of virtually noiseless operation suitable for use in restaurants, lounges, lobbies, etc., where sign operating noise would be objectionable; the provision of a motorized sign wherein six or more frontal displays are possible in a sign of compact construction of a size suited for use on a counter or shelf of a commercial establishment. Additional objectives will become subsequently apparent upon an understanding of the invention as hereinafter described.

DETAILED DESCRIPTION OF THE PREFERRED EMBODIMENT

Figures 1, 2, 3, 4, 5, 6, 7, 8:
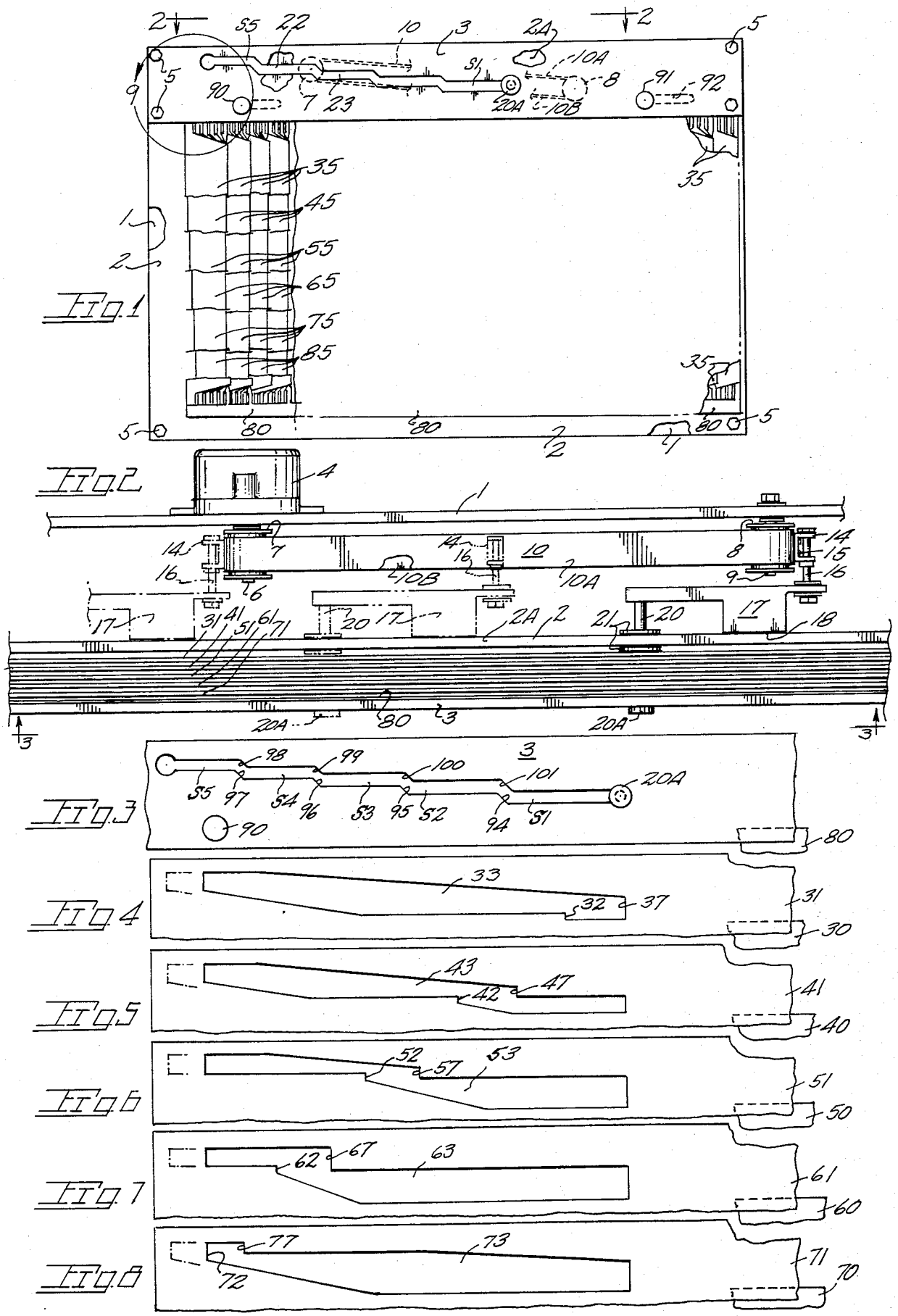
FIG. 1 is a front elevational view of the present sign.
FIG. 2 is a horizontal view of the sign taken downwardly along line 2—2 of FIG. 1 and showing details of the drive mechanism.
FIG. 3 is an enlarged fragmentary view of an arm guide plate of the sign taken along line 3—3 of FIG. 2.
FIGS. 4 through 8 are fragmentary panel views showing the upper semi-rigid member of each panel and an enclosed area defined thereby within which a belt carried arm travels.

With continuing attention to the drawings wherein applied reference numerals indicate parts as hereinafter similarly identified, the reference numeral 1 indicates a sign back wall or base which may be suitably affixed to a supporting vertical wall or equipped with stand components to enable upright placement on a horizontal surface.

Mounted to sign back wall 1 in a forwardly spaced manner is a front wall 2 of like size. Forwardly offset from the upper portion of front wall 2 are guide means including a plate 3 extending the length of the sign. A companion guide plate 2A is formed integral with front wall 2. The guide plates define aligned guideways as later described.

Fastener assemblies at 5 include spacer elements to maintain the base back and front walls, as well as guide plate 3 in parallel spaced relationship with one another.

PANEL DRIVE MECHANISM

An electric motor at 4 on the sign back wall includes an internal reduction drive to greatly reduce the speed of an output shaft 6 fitted with a drive roll 7. An idler roll at 8 is journaled on a spindle 9 secured in place on the sign back wall. The rolls are flanged to confine a continuous belt 10 in place thereon and having upper and lower runs 10A and 10B. Secured to the belt is a U-shaped bracket 14 with fastening means at 15 securing same to the belt. The rolls 7 and 8 are preferably of a resilient material to permit passage of the fastening means thereover without noise or loss of traction. Bracket 14 carries a pin 16 which projects forwardly to rotatably engage an arm assembly including an arm equipped block 17 having a bearing surface 18 which rides in surfacial contact with the back side of front wall 2 and more specifically that portion thereof constituting guide plate 2A. An arm 20 is thereby maintained in perpendicular relationship to the guide plates and to a later described series of panels. Arm 20 is equipped with a pair of retainers 21 which ride on opposite sides of guide plate 2A and contribute to arm stability. The arm 20 terminates outwardly in a head 20A which is of a diameter greater than the width of the opening in remaining guide plate 3. Belt 10 is later referred to as a continuous member.

With reference to FIGS. 1 and 2, it will be seen that arm 20 may traverse the full length of corresponding stepped openings or guideways at 22 and 23 in the front wall supported guide plate 2A and guide plate 3. Passage of arm 20 along the corresponding guideways to the left in FIG. 1 is associated with the travel of bracket 14 along lower run 10B of belt 10 with return of the arm to the right to its starting positon (shown in FIG. 1) associated with bracket travel along upper belt run 10A. The extremes of arm travel in the guideways are reached when bracket 14 passes about the belt carrying rolls.

SIGN PANELS

In between front wall 2 of the sign and guide plate 3 are several movable sign panels at 30, 40, 50, 60, and 70 with a like panel at 80 being stationary in place on the back side of guide plate 3 to provide a sign with a potential of six different frontal displays. Panel supporting pins at 90 and 91 are supported by front wall guide plate 2A and guide plate 3. Each of the movable panels is slotted as at 92 to permit horizontal movement of same on the supporting pins.

Each of the movable panels of rectangular shape includes a semi-rigid upper member 31, 41, 51, 61 and 71 to which the upper margin of the panel's pliable portion is secured (FIGS. 4 through 8) as by a suitable adhesive. Each panel includes a multitude of strips, panel 30 strips at 35, panel 40 strips at 45, panel 50 strips at 55, panel 60 strips at 65, panel 70 strips at 75 and panel 80 strips at 85. The strips of one panel, when exposed to view, form a composite display.

Each movable panel (i.e., all but panel 80) defines an opening or open area as at 33, 43, 53, 63 and 73 within which belt carried arm 20 travels back and forth to impart panel movement, in a sequential manner, starting with panel 30 when starting from its FIG. 1 position.

With attention back to the guide plates 2A and 3, the matched guideways 22 and 23 formed therein are irregular or step-like so as to confine the arm for travel in several planes in areas S1, S2, S3, S4 and S5. Inclined segments of the guideways are defined by inclined guideway surfaces which act as cams on belt carried arm 20. As arm 20 moves from right to left from its FIG. 1 position it initially contacts an abutment 32 projecting inwardly into open area 33 of panel 30 with the panel being shifted by the arm to the left until said arm is lifted out of abutment contact by inclined guideway surfaces at 94. Accordingly, panel 30 and its strips 35 are repositioned, as best viewed in FIG. 10, to the left to expose to view the underlying strips 45 of panel 40. Strips 45 remain visible as the arm 20 continuously moves along the guideway opening until it contacts abutment 42 on panel 40 and subsequently shifts panel 40 to the left until arm 20 is again elevated out of abutment contact by inclined guideway surfaces as at 95. Continued arm travel to the left results in the arm sequentially contacting inwardly projecting abutments 52, 62 on panels 50 and 60 to reposition the panels to the left to expose the underlying strips and the composite display thereon of the underlying or rearward panel. Inclined surfaces at 96 and 97 serve to lift arm 20 out of abutment contact.

Ultimately arm 20 contacts an edge 72 of panel 70 and repositions the panel to the left as indicated by the broken line edge position to expose stationary panel 80 and its strips 85 to render the sixth composite display. Panel 80 is, as shown in FIG. 4, affixed to the rearward lower edge of guide plate 3.

Subsequent shifting of the panels from left to right to complete the remaining half of one cycle of sign operation occurs as belt propelled arm block 17 commences passage from left to right under the influence of belt mounted bracket 14 as it passes upwardly about drive roll 7. Arm 20 is moved from its extreme position at the guideway left end to contact an abutment 77 projecting into open area 73 panel 70 to reposition the panel back to its full line position of FIG. 8 and thereby causing its strips 75 to move into view to make a composite display while simultaneously blocking from view underlying strips 85 of stationary panel 80. Arm 20 eventually contacts inclined surface 98 of the guideway to cause downward arm disengagement from abutment 77 whereupon the display remains static until moving arm 20 later contacts such an abutment 67 on panel 60. Thereafter arm 20 moves into abutment disengaging contact with inclined surface 99 and thence into contact with a like abutment 57 on panel 50 with subsequent disengagement therefrom by guideway surface 100. Continued travel to the right brings arm 20 into panel shifting contact with an inwardly projecting abutment 47, abutment disengaging contact with guideway surface 101 and ultimately contact with upright edge abutment 37 on panel 30 to draw the panel's strips 35 into view and into their overlying, or frontal starting position on each interleaved row of panel strips. During sign operation each set of panel strips remains visible for several seconds between arm disengagement from an abutment and arm contact with the abutment of the next panel to be positioned.

Figure 9:
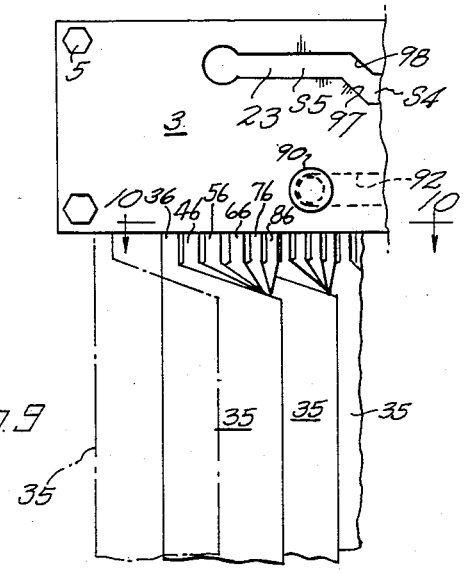
FIG. 9 is an enlarged view of that portion of the sign encircled at 9 in FIG. 1.
Figure 10:
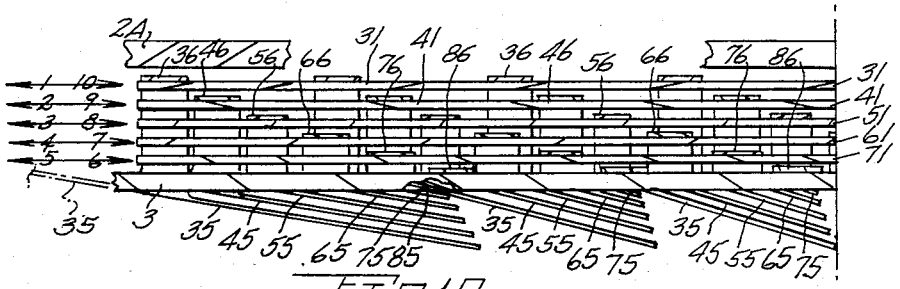
FIG. 10 is a horizontal sectional view taken downwardly along line 10—10 of FIG. 9.
Figure 11:
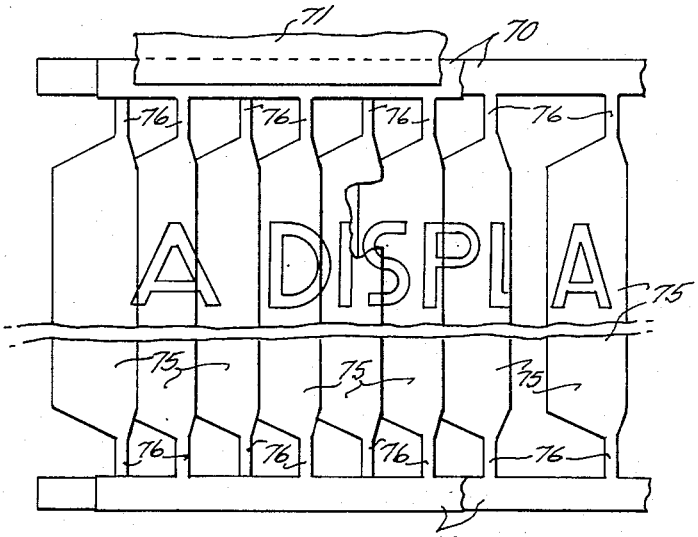
FIG. 11 is a fragmentary elevational view of a typical two ply panel with overlapped strips used in the present sign.

With reference to FIGS. 9, 10 and 11, it will be seen that the strips of each panel are flexibly joined to continuous top and bottom panel margins by panel extensions of reduced width as at 36, 46, 56, 66, 76 and 86. The panels and extensions are formed from thin, pliable sheets rendering both the panel strips and particularly the strip extensions capable of lengthwise flexing as well as a degree of strip and extension rotational or twisting movement. The sequence of travel from right-to-left and then left to right is indicated by the numbered arrows in FIG. 10.

In one embodiment of the sign the belt rolls are spaced apart nine and one-half inches on a centerline that is inclined so as to permit the belt runs to be inclined at about the same inclination as an inclined plane intersecting the guideways 22 and 23 which are approximately eleven and one half inches in length. To assure uninterrupted sliding passage of the interleaved panel strips it has been found preferable to form the strips of each sign panel of somewhat different width than those strips on each of the remaining sign panels. For example, the strips 35 of panel 30 are each of one and one-half inch width; the strips 45 of panel 40 are each of one and fourteen thirty-seconds inch width; the strips 55 of panel 50 are each of one and twelve thirty-seconds inch width; the strips 65 of panel 60 are each of one and ten thirty-seconds inch width; the strips 75 of panel 70 are each of one and eight thirty-seconds inch width, while the strips 85 of stationary panel 80 are each of one and six thirty-seconds inch width. The strip extensions 36, 46, 56, 66, 76 and 86 have adequate flexibility when of a length of about five-eighths of an inch. Plastic coated paper has been found suitable as panel material as same is durable, flexible and avoids static electricity build-up, a problem encountered with at least some all plastic panels. Panel movement has been found suitable when only about three-quarters of an inch in each direction since the two ply panel feature permits a much greater number of strips and the strips of each panel to overlie adjacent strips of the same panel which would not be the case from strips formed from a single sheet of material. In an operable sign, of course, the adjacent strips of one panel will be in separate rows of strips with other panel strips interposed therebetween.

The two ply concept is typically illustrated in FIG. 11 wherein panel 70 is illustrated with panel upper and lower margins being superimposed with like margins of the underlying panel component of panel 70. For ease of manufacture identical panel components may be utilized with one of the panels in offset securement to the other to provide the overlapped strip feature.

While the above described sign is noted as having five movable panels, it is believed readily apparent that a sign having a greater number of movable panels may be constructed requiring only modification of certain sign components in an obvious manner.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A sign having sequentially displayed panels comprised of strips interleaved with the strips of adjacent sign panels, said sign comprising, a base including guide means defining an elongate opening, panels movably supported on the sign base and each including a multitude of strips with the strips of each panel rendering a composite display when visible, said panel strips being interleaved with the strips of the remaining sign panels, a panel drive mechanism including a motor and a continuous member driven by said motor and having a pair of runs, an arm carried by said continuous member, means coupling said arm to said continuous member and imparting movement to said arm for reciprocal travel along the guide means opening with each direction of arm travel associated with one run of the continuous member, said panels defining openings within which said arm travels with abutments on said panels partially defining the panel openings, and said guide means including inclined surfaces at intervals along said guideway opening whereby said arm will be guided out of contact with an abutment on one panel for subsequent contact with an abutment on a remaining panel to cause repositioning of said one panel and its strips to change a display of the sign.

2. The sign claimed in claim 1 wherein said elongate opening is of step-like configuration to guide said arm into and out of panel abutment engagement.

3. The sign claimed in claim 2 wherein some of said panels include multiple abutments one each for engagement by said arm during arm travel along said elongate opening in each direction of arm travel, the abutments of different panels being located on their respective panels so as to be individually contacted by said arm.

4. The sign claimed in claim 1 wherein the strips of each panel partially overlap one another with like strips of the remaining panels located therebetween.

5. The sign claimed in claim 4 wherein each of said panels is of two ply construction.

6. A sign having a plurality of panels with each panel comprising a multitude of joined strips with the strips of each panel providing a composite display, said sign comprising, a base including guide means defining a non-linear elongate opening, panels supported on said base for intermittent rectilinear movement to expose to view composite displays one each display on the several strips of each panel, said panel strips in interleaved relationship with the strips of the remaining panels, a panel drive mechanism including a motor, a continuous belt, roll means on which said belt is entrained powered by said motor, an arm coupled to said belt and constrained for rectilinear travel along said opening during motor operation, said panels each including abutments located in the path of said arm whereby motion is imparted to a panel by arm contact with a panel abutment, and said guide means defined non-linear opening shaped at intervals to divert said arm along an inclined path and ultimately out of abutting engagement with a panel abutment whereby panel motion is terminated.

7. The sign claimed in claim 6 wherein the strips of each panel in addition to being interleaved with the strips of remaining panels partially overlap strips of the same panel.

8. The sign claimed in claim 7 wherein the panels are of two ply construction.

9. The sign claimed in claim 8 wherein the strips of one sign panel are of a different width than the strips of the remaining panels to at all times assure at least partial surfacial relationship between adjacent strips of different panels.

10. The sign claimed in claim 9 wherein said non-linear opening is of step-like configuration.

* * * * *